US011187199B2

(12) United States Patent
Jeannel et al.

(10) Patent No.: US 11,187,199 B2
(45) Date of Patent: Nov. 30, 2021

(54) SPRAY ORIFICE DISK AND VALVE

(71) Applicant: Robert Bosch GmbH, Stuttgart (DE)

(72) Inventors: Laurent Jeannel, Ditzingen (DE); Franz Thoemmes, Bietigheim-Bissingen (DE); Tilo Starkert, Dettingen Unter Teck (DE)

(73) Assignee: Robert Bosch GmbH, Stuttgart (DE)

( * ) Notice: Subject to any disclaimer, the term of this patent is extended or adjusted under 35 U.S.C. 154(b) by 154 days.

(21) Appl. No.: 16/060,204

(22) PCT Filed: Oct. 19, 2016

(86) PCT No.: PCT/EP2016/075058
§ 371 (c)(1),
(2) Date: Jun. 7, 2018

(87) PCT Pub. No.: WO2017/102139
PCT Pub. Date: Jun. 22, 2017

(65) Prior Publication Data

US 2018/0372047 A1 Dec. 27, 2018

(30) Foreign Application Priority Data

Dec. 15, 2015 (DE) ..... 102015225338.4

(51) Int. Cl.
*F02M 61/18* (2006.01)
*F02M 61/16* (2006.01)

(52) U.S. Cl.
CPC ..... *F02M 61/162* (2013.01); *F02M 61/184* (2013.01); *F02M 61/1806* (2013.01); *F02M 61/1853* (2013.01); *F01N 2610/1453* (2013.01)

(58) Field of Classification Search
CPC ..... F02M 61/162; F02M 61/1806; F02M 61/184; F02M 61/1853
See application file for complete search history.

(56) References Cited

U.S. PATENT DOCUMENTS

2003/0141385 A1* 7/2003 Xu ..... F02M 61/1853 239/463
2012/0325922 A1 12/2012 Sumida et al.
(Continued)

FOREIGN PATENT DOCUMENTS

DE 102012211191 A1 1/2014
DE 102013209272 A1 11/2014
(Continued)

OTHER PUBLICATIONS

International Search Report dated Dec. 23, 2016, of the corresponding International Application PCT/EP2016/075058 filed Oct. 19, 2016.

*Primary Examiner* — Tuongminh N Pham
(74) *Attorney, Agent, or Firm* — Norton Rose Fulbright US LLP; Gerard Messina

(57) ABSTRACT

A spray orifice disk for a valve for a flowing fluid and, in particular, for a metering or injection valve for an internal combustion engine, including a disk body and a spray orifice set-up, which is formed in the disk body and is configured with at least one spray orifice for dispensing supplied fluid, and including at least one channel for supplying the fluid to the spray orifice. The spray orifice, the channel and/or the transition between the channel and the spray orifice being configured to form a swirl geometry of the spray orifice disk in such a manner, that during operation, due to interaction of one or more jets of the fluid emerging from the spray orifice in turbulence atomization, an oval cross-sectional pattern of the spray is formed, in particular, in the form of a flat spray.

6 Claims, 10 Drawing Sheets

(56) References Cited

U.S. PATENT DOCUMENTS

| | | | | |
|---|---|---|---|---|
| 2014/0158090 | A1* | 6/2014 | Sumida | F02M 61/1853 123/445 |
| 2017/0065990 | A1* | 3/2017 | Gopalan | B05B 11/30 |

FOREIGN PATENT DOCUMENTS

| | | | |
|---|---|---|---|
| JP | 2008255912 | A | 10/2008 |
| JP | 2013185522 | A | 9/2013 |
| JP | 2014031758 | A | 2/2014 |
| WO | 2006025114 | A1 | 3/2006 |

* cited by examiner

SPRAY ORIFICE DISK AND VALVE

BACKGROUND INFORMATION

The present invention relates to a spray orifice disk and a valve. The present invention relates to, in particular, a spray orifice disk for a valve for a flowing fluid and, in particular, for a metering or injection value for an internal combustion engine and/or for exhaust gas aftertreatment, as well as to a valve for a flowing fluid and, in particular, a metering or an injection valve for an internal combustion engine and/or for exhaust gas aftertreatment.

In valves for flowing fluids and, in particular, in metering or injection valves for internal combustion engines, in particular specific embodiments, a valve seat body, which terminates a valve chamber, has a so-called spray orifice disk downstream from it in the direction of flow of the fluid, the spray orifice disk including at least one spray orifice, which is used for dispensing the fluid from the valve chamber into a delivery space, for example, into a combustion chamber or the like.

In this context, so-called turbulence atomization of the flowing fluid in the transition from the spray orifice of the spray orifice disk into the delivery space of the fluid is used for treatment. In particular, in the case of comparatively low pressures, this may result in non-uniform jet distribution and/or in comparatively large drops. In many applications, this is not desired, or this is even disadvantageous.

SUMMARY

The spray orifice disk of the present invention may have the advantage that when used in a valve, a comparatively uniform distribution of the droplets in the atomization cone may be attained with a reduction in the droplet size. According to the present invention, this may be achieved in that a spray orifice disk for a valve for a flowing fluid and, in particular, for a metering or injection valve for an internal combustion engine is provided; the spray orifice disk including a disk body and a spray orifice set-up formed in the disk body, the spray orifice set-up being configured with at least one spray orifice for dispensing supplied fluid as a spray, as well as with at least one respective channel for supplying the fluid to the spray orifice; the spray orifice, the channel and/or the transition between the channel and spray orifice being configured to form a swirl geometry of the spray orifice disk in such a manner, that during operation, due to interaction of one or more jets of the fluid emerging from the spray orifice in atomization, an oval cross-sectional pattern of the spray is formed, in particular, in the form of a flat spray. Thus, according to the present invention, by appropriately adapting the combination of the spray orifice, the supplying channel and/or the transition between the channel and the spray orifice, the swirl geometry of the spray orifice disk is selected in such a manner, that an oval cross-sectional pattern of the atomization cone or spray is formed via the intrinsic interaction of a single jet or the interaction of a plurality of jets of a fluid emerging in atomization from the spray orifice set-up. In this manner, in particular, a flat shape of the atomization cone in the sense of a flat spray having a uniform spray distribution may be attained.

In the technical context of the present invention, the terms atomization cone, spray cone and spray are used synonymously.

Preferred further refinements of the present invention are described herein.

In one advantageous developmental form of the spray orifice disk according to the present invention, the swirl geometry is configured in such a manner, that the oval cross-sectional pattern of the atomization cone or spray may be generated (i) at low pressures in the range of approximately $3\cdot10^5$ Pa (3 bar) to approximately $10\cdot10^5$ Pa (10 bar), (ii) with a uniform distribution of the fluid in the spray, and/or (iii) with a reduced droplet size of the spray, having an SMD value of less than 80 μm. In this manner, areas of application of the spray orifice disk of the present invention and of a valve equipped with the spray orifice disk are also possible, in which, to date, only comparatively poorer results were able to be obtained, for example, in view of the uniformity of the atomization cone and/or the distribution of the droplet sizes.

Particularly advantageous characteristics may be obtained in the atomization cone or spray, if a swirl chamber is formed in the transition between a particular channel and a respective spray orifice, or if this transition is formed at least partially by a swirl chamber.

The interaction of a plurality of jets in combination with each other also offers advantages, in particular, in view of the overall shape of the atomization cone, its direction and/or its cross-sectional shape. Thus, according to a preferred specific embodiment of the spray orifice disk of the present invention, it is provided that an, in particular, even-numbered plurality of spray orifices be formed, each having a channel.

In this context, it is particularly advantageous, if, by adjusting an angular spacing of the spray orifices and/or of the channels with respect to each other, in particular, with regard to a lateral center of the spray orifice disk, jet pairs may be formed during operation by pairs of spray orifices, and the oval cross-sectional pattern of the spray may be formed, in particular, in the range of approximately 30° to approximately 70°, by combining individual jets.

A symmetric shape of the atomization cone is produced, inter alia, when, in accordance with another advantageous further refinement of the spray orifice disk of the present invention, a plurality of spray orifices is formed, which are situated, in particular, on a circular line or distributed in groups on a plurality of circular lines, in particular, concentrically about the center of the spray orifice disk.

In order to obtain, in particular, an oval shape that is stretched out in length, but otherwise symmetric, the spray orifices may be arranged in groups on a plurality of circular lines.

In the development of the spray orifice disk of the present invention, depending on the application, there are also varied geometries with regard to the channels supplying the flowing fluid.

In one further refinement of the spray orifice disk of the present invention, the channels provided may be formed in parallel with each other and/or have the same length, alternatingly subtend, directly adjacently to each other, a first smaller angle or a second larger angle between them, with reference to the center of the spray orifice disk, and/or have, directly adjacently to each other, a first lesser length or a second greater length in an alternating manner.

These characteristics may optionally be combined with each other, in order to be able to satisfy requirements in particular applications.

In addition, the characteristics of the atomization cone may be developed further by influencing the jet swirl. Thus, in another specific embodiment of the spray orifice disk of the present invention, it may be provided that swirl chambers of directly adjacent spray orifices have swirl directions opposite to each other.

In addition, adaptation of the cross-sectional shape of the specific spray orifice, thus, in particular, perpendicular to the flow direction of the fluid, provides options for influencing the shape of the atomization cone and its further characteristics, e.g., the droplet size distribution inside the atomization cone. Thus, in a further refinement of the spray orifice disk of the present invention, it may be provided that a specific spray orifice have a circular or a non-circular and, in particular, an oval or elliptical cross section.

Further geometric and/or structural characteristics of the spray orifice disk of the present invention also provide adaptation options, in order to design the characteristics of the resulting atomization cone(s) for the respective application.

Thus, according to different developmental forms of the spray orifice plate of the present invention, it may be provided that during operation, the oval cross-sectional pattern of the atomization cone or of the spray and, in particular, the flat spray or the flat-formed atomization cone be developed further, in that by adapting (i) the number and/or layout of the spray orifices, (ii) the angle of inclination and/or the shape of the spray orifices, (iii) the number and/or the layout of the channels, (iv) the relative layout of spray orifices and/or channels with respect to each other, and/or (v) the swirl intensity, in particular, also in connection with provided swirl chambers and their layout, shape and orientation with respect to a specific channel and/or spray orifice, during operation, the oval cross-sectional pattern of the spray and, in particular, the flat spray, may be shaped.

Furthermore, the present invention relates to a valve for a flowing fluid and, in particular, a metering or injection valve for an internal combustion engine. According to the present invention, this valve is configured with a valve seat body, which terminates a valve chamber and has a valve opening, as well as with a spray orifice disk situated downstream from the valve seat body. The spray orifice disk has the shape described according to the present invention, so that upon use of the valve of the present invention, an atomization cone or spray having a comparatively uniform distribution and possibly reduced mean droplet size is produced, in particular, in the form of flat-shaped atomization cone, or in the form of a flat spray.

Specific embodiments of the present invention are described in detail, with reference to the figures.

BRIEF DESCRIPTION OF THE DRAWINGS

FIGS. 2, 3-1 and 3-2 are a schematic and sectional side view and top views of specific embodiments of a spray orifice disk according to the present invention.

DETAILED DESCRIPTION OF EXAMPLE EMBODIMENTS

Figure 1:
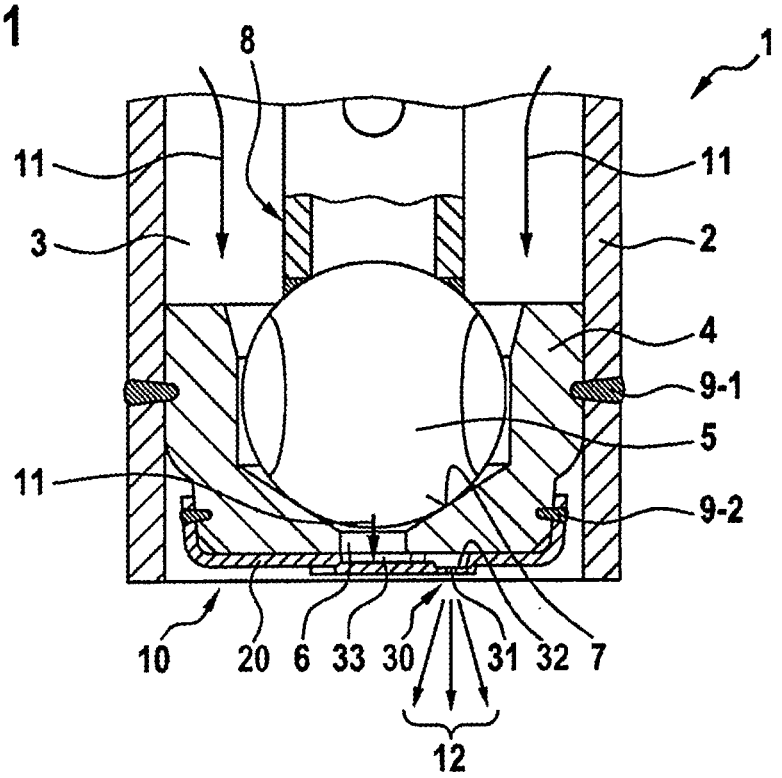
FIG. 1 is a schematic and sectional side view of a part of a valve according to the present invention.

In the following, exemplary embodiments of the present invention are described in detail, with reference to FIGS. 1 through 20. Identical elements and components, as well as elements and components that function equally or equivalently, are denoted by the same reference numerals. The detailed description of designated elements and components is not repeated in every instance of their appearance.

The depicted features and further characteristics may be isolated from one another as desired, and combined arbitrarily with one another, without departing from the essence of the present invention.

FIG. 1 shows a schematic and sectional side view of a detail of a specific embodiment of a valve 1 according to the present invention, which utilizes a spray orifice disk 10 of the present invention.

Valve 1 includes a valve seat support 2, in the lower region of which valve seat 7 is formed and attached to valve seat support 2 via first fastening element 9-1. At its lower end, a valve member 8 includes a closing head 5, which, in this case, is spherically shaped and may be seated on valve seat 7 in a controlled manner, in order to occlude or uncover a valve opening 6 in a controlled manner. Valve seat 7 is formed by a conical surface of a valve seat body 4 and includes valve opening 6 at its lower end. At the endface of valve seat body 4 and opposite to valve opening 6, a spray orifice disk 10 of the present invention, which includes a disk body 20 and a spray orifice set-up 30, is attached to the outside of valve seat body 4 by second fastening elements 9-2.

Spray orifice disk 10 includes several openings, via which one or more spray orifices 31 of the spray orifice set-up are formed on the one side. On the other side, flowing fluid 11 is directed from valve chamber 3 through valve opening 6 to spray orifices 31, with the aid of channels 33 leading to spray orifice 31, and optionally via swirl chambers 32 formed in the transition between channels 33 and respective spray orifices 31.

Flowing fluid 11 leaves valve 1 through a specific spray orifice 31, in the form of one or more atomization cones 12, which are synonymously referred to as spray or spray cones, as well.

Figure 2:
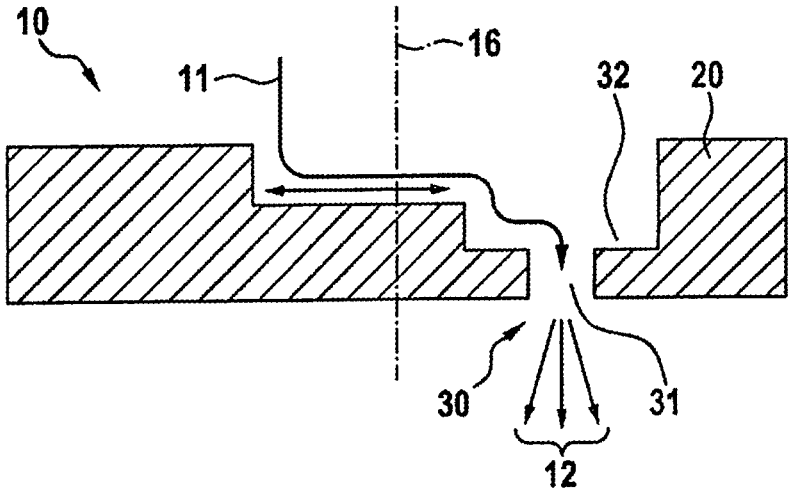
Figures 1, 3:
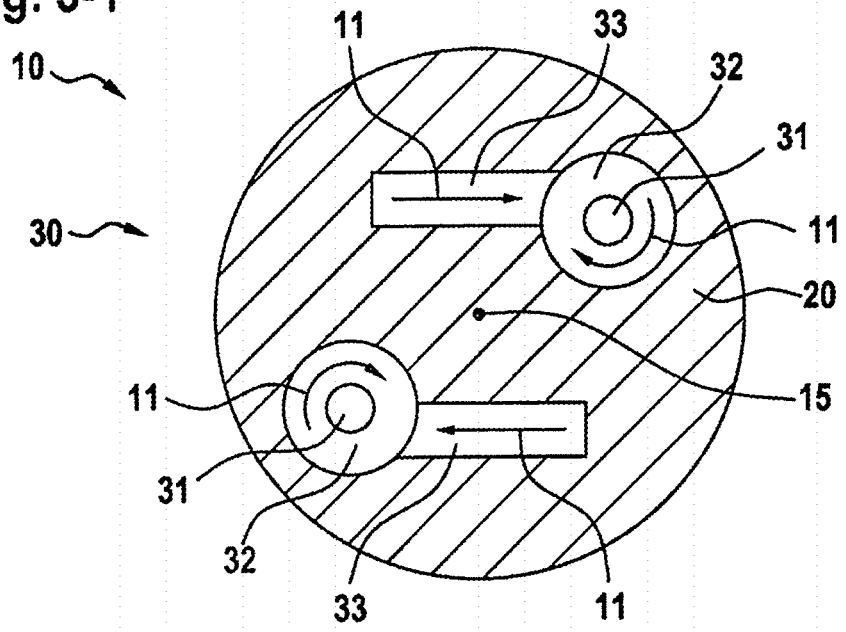
Figures 2, 3:
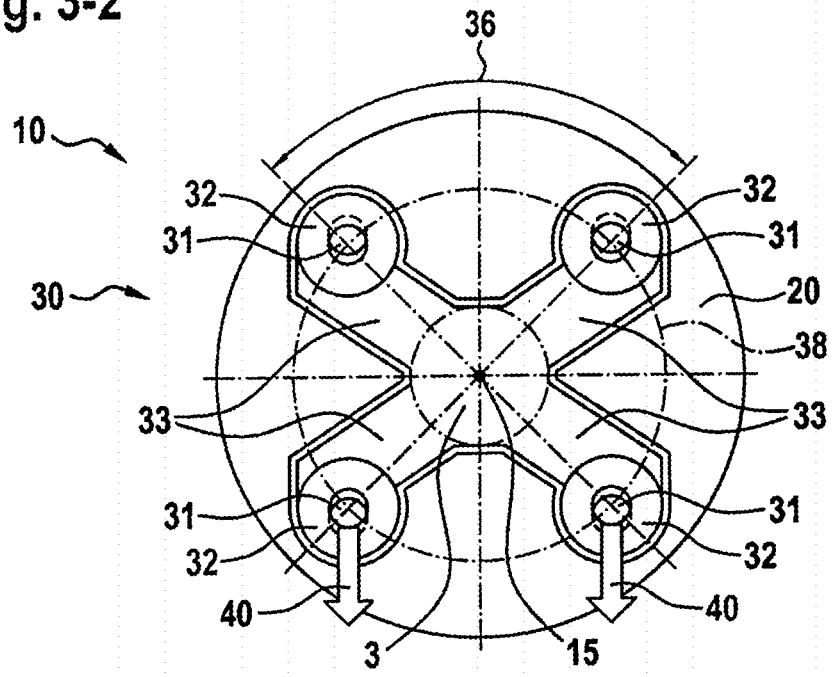

FIGS. 2 and 3-1 show a schematic and sectional side view and a schematic and sectional top view of a specific embodiment of the spray orifice disk 10 of the present invention, having two spray orifices 31. Spray orifices 31 are formed in disk body 20 as vertical spray orifices 31. In use, as shown in FIG. 1, they are fluid-mechanically in contact with the side of spray orifice disk 10 facing way from spray orifice 31, and there, with corresponding valve opening 6, via a respective channel 33, and, in the transition between channel 33 and spray orifice 31, with a swirl chamber 32.

Two spray orifices 31 are formed in the specific embodiment of FIG. 3-1. The number and the geometry of spray orifices 31 may be varied, in order to adapt the advantages produced by the present invention, regarding the geometry of spray cone 12, its uniformity, as well as the droplet size distribution.

In the specific embodiment of FIG. 3-1, channels 33, which convey flowing fluid 11, are linear and are placed eccentrically with regard to the spray orifice geometry. The shape of channels 33 and the degree of eccentricity may be varied, as well.

The same applies to swirl chambers 32 and their size, orientation and shape.

In FIGS. 2 and 3-1, the spray orifice disk has essentially the shape of a circular disk having lateral center 15 and center axis 16.

FIG. 3-2 shows a schematic and partly sectional top view of a specific embodiment of the spray orifice disk 10 of the present invention, comparable to the view of FIG. 3-1, but having a 4-hole, 4-channel configuration. Thus, this spray orifice disk 10 is formed with (i) a spray orifice set-up 30 having four spray orifices 31, which are situated on a circular line 38, concentrically about lateral center 15 of spray orifice disk 10, (ii) four supplying channels 33, pairs of which subtend an angle 36 about lateral center 15, and (iii) in each instance, a swirl chamber 32 between channel 33 and spray orifice 31. In operation, using the design, geometry and relative layout of channels 33, swirl chambers 32 and spray orifices 31, a corresponding momentum 40 is generated for flowing fluid 11 and the atomization cones 12 forming at the outlet of the spray orifices.

In a form analogous to FIG. 3-2, FIGS. 4 to 6 show schematic and partly sectional top views of other refinements of the spray orifice disk 10 of the present invention, having a 4-hole, 4-channel configuration.

Figure 4:
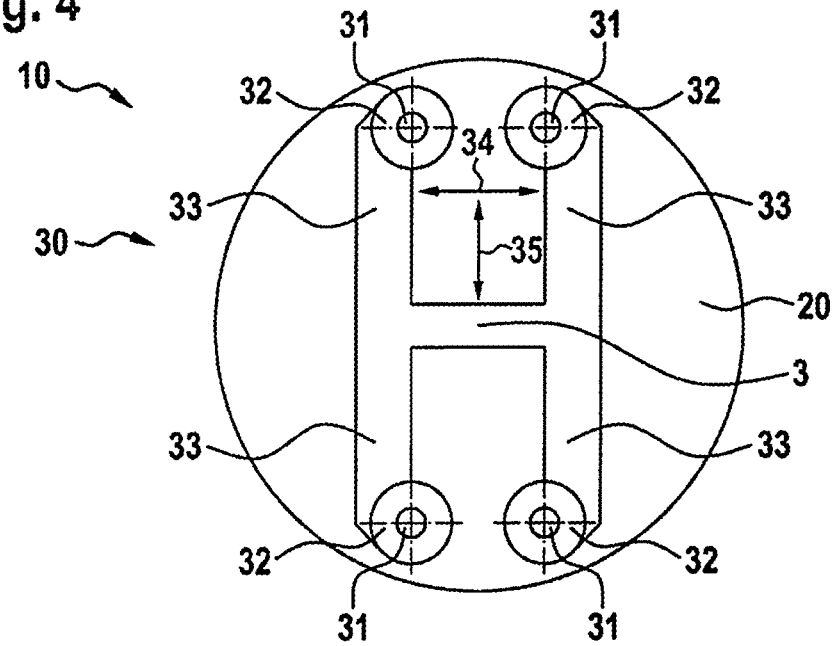
FIGS. 4 through 6 show specific embodiments of the spray orifice disk of the present invention, having a 4-hole, 4-channel geometry.

In the specific embodiment of FIG. 4, there is a 4-hole, 4-channel geometry including four equal-length channels 33 parallel to each other, via which flowing fluid 11 is supplied to four spray orifices 31 having their swirl chambers 32 in between. Channel spacings 34 and channel lengths 35 may be varied to refine atomization cone 12 or atomization cones 12, in a manner analogous to the geometries and layouts of channels 33, of swirl chambers 32 and also of the spray orifices 31 themselves.

Figure 5:
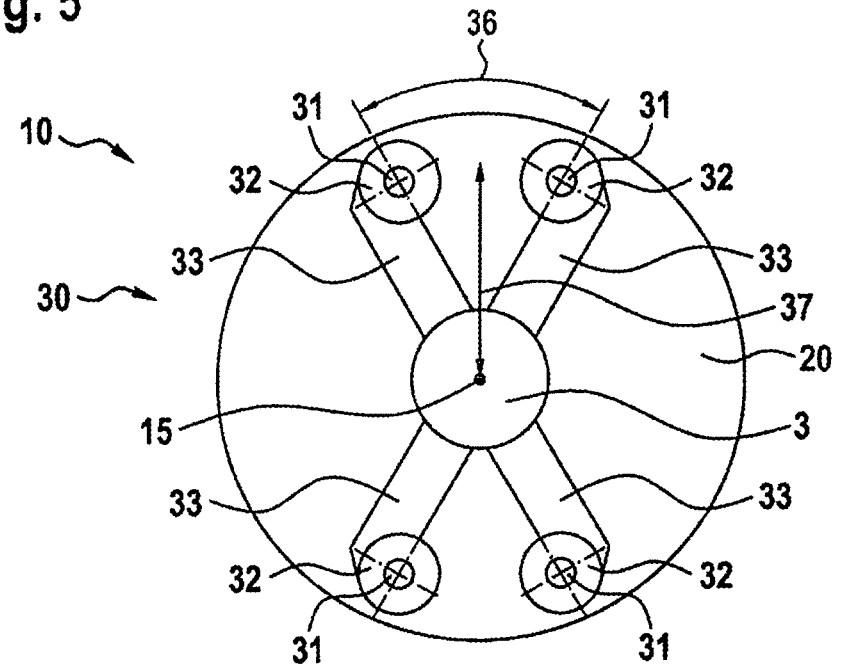

FIG. 5 shows likewise a 4-hole, 4-channel geometry, in which pairs of the four channels 33 subtend a particular, first channel angle 36. This may be varied in the same manner as central distance 37 from lateral center 35 of spray orifice disk 10, in order to adjust the characteristics of atomization cone 12 or atomization cones 12.

Figure 6:
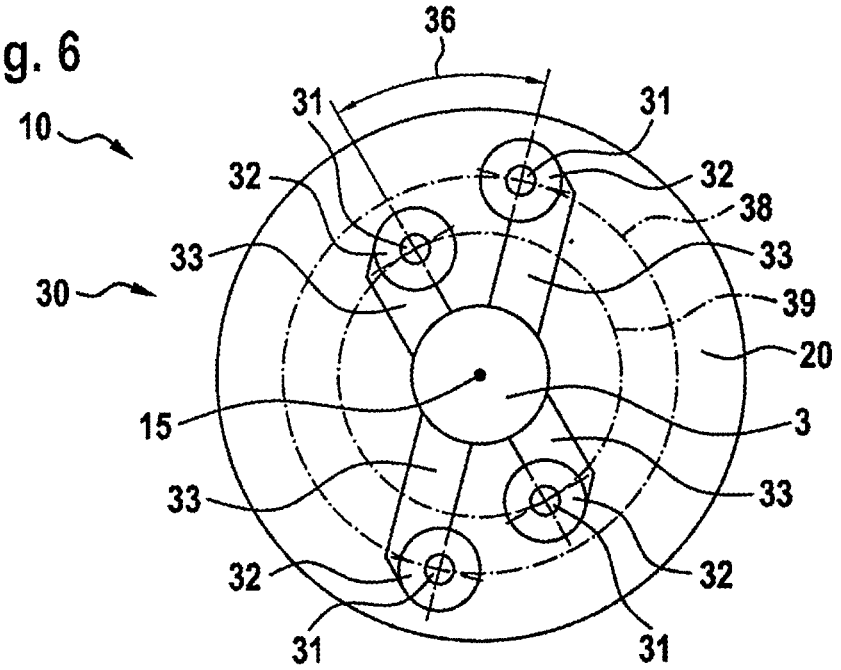

In the specific embodiment according to FIG. 6, a 4-hole, 4-channel geometry is formed, in which first spray orifices 31 of spray orifice pairs are situated on a first circle 38 having a greater circle diameter and second spray orifices 31 of the spray orifice pairs are situated on a second circle 39 of lesser diameter. The pairs of spray orifices 31 and their channels 33 form, in turn, an angle 36 between them. Configuration circles 38 and 39 are concentric with respect to lateral center 15 of spray orifice disk 10.

In this case, besides angle 36, the diameters of circles 38 and 39 may be suitably adjusted, in order to obtain certain characteristics of atomization cone 12 or atomization cones 12.

Figure 7:
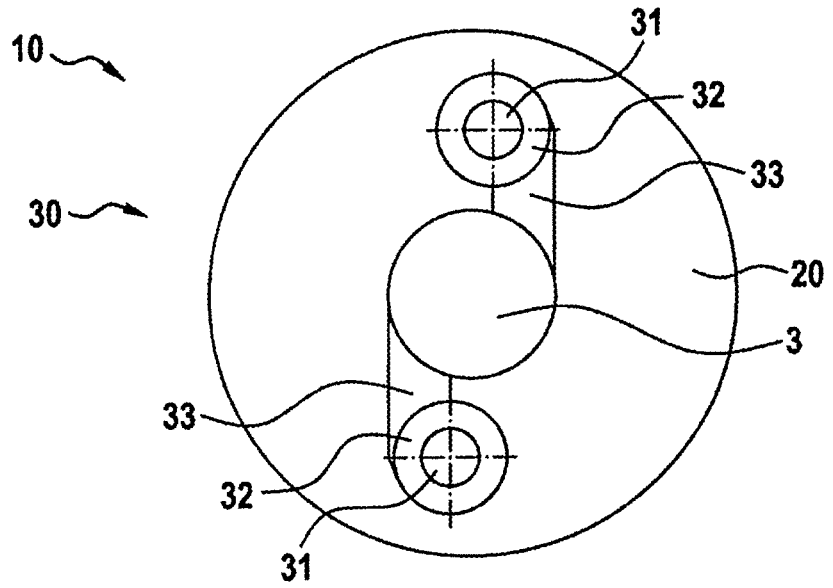
FIGS. 7 and 8 show schematic and sectional top views of specific embodiments of the spray orifice disk according to the present invention, having a 2-hole, 2-channel geometry and a combination including two colliding jets.
Figure 8:
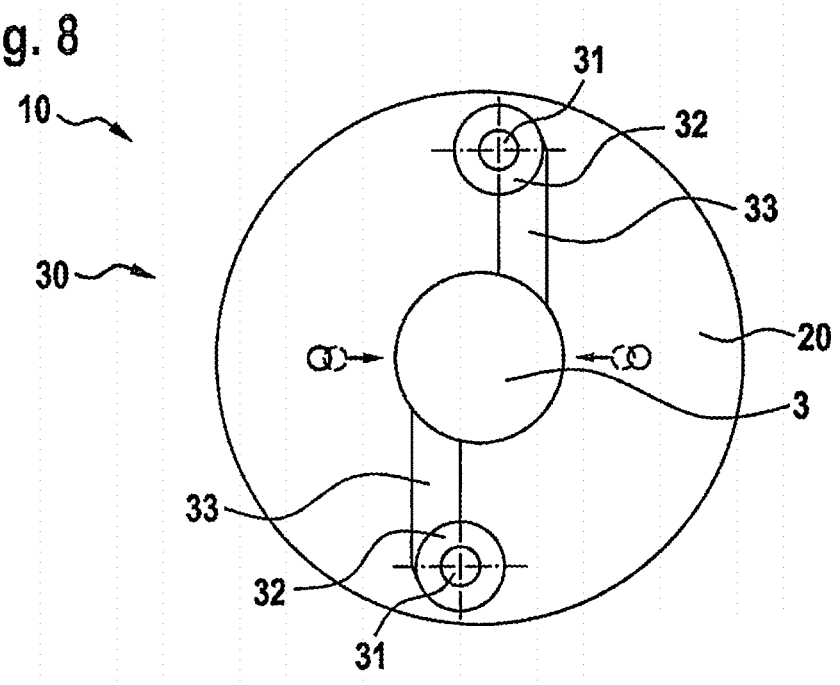
Figure 9:
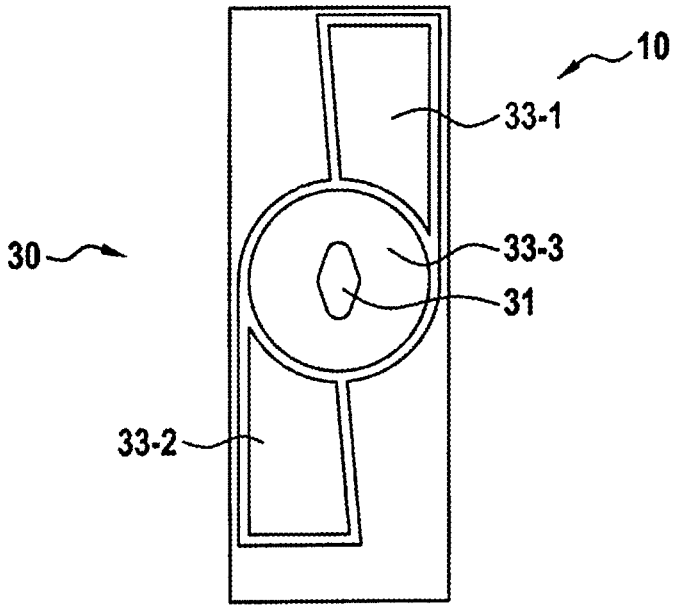
FIGS. 9 and 10 show schematic and sectional top views of specific embodiments of the spray orifice disk according to the present invention, having a 1-hole, 2-channel geometry.
Figure 10:
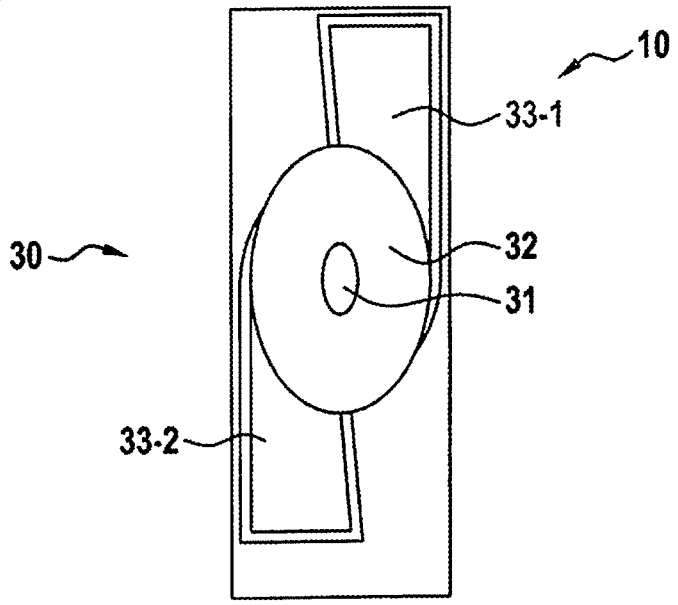
Figure 11:
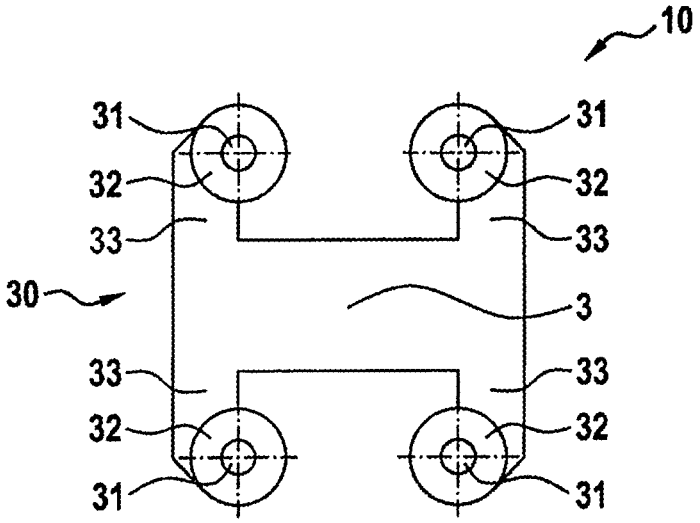
FIGS. 11 through 20 show different specific embodiments of the spray orifice disk according to the present invention, having a 4-hole, 4-channel geometry and corresponding embodiments of the spray orifices, the atomization cones, and their cross sections.
Figure 12:
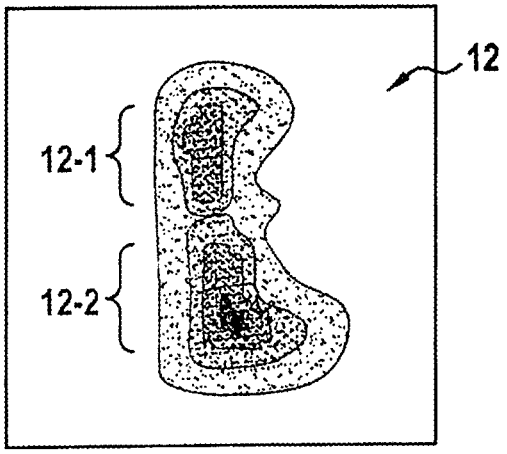

FIGS. 7 and 8 show two specific embodiments of spray orifice disk 10 of the present invention, having a 2-hole, 2-channel configuration or geometry. FIGS. 9 and 10 show specific embodiments of spray orifice disk 10 of the present invention, having a 1-hole, 2-channel geometry including an oval spray orifice 31.

In the specific embodiment of FIG. 10, a swirl chamber 32 is additionally formed in the transition between channel 33 and actual spray orifice 31.

FIGS. 11 through 20 show spray orifice disks 10 of the present invention, having a 4-hole, 4-channel geometry and swirl chambers 32. In these specific embodiments, in each instance, two channels 33 are oriented in parallel with each other. The rotational direction of swirl chambers 32 are opposed for pairs of spray orifices 31, so that due to this, after emergence of flowing fluid 11 from spray orifice 31, the air of the atmosphere is drawn into the center of the jet, and individual jets 12-1, 12-2 form into a common and oval atomization cone 12. In this context, the direction of momentum is determined by the layout of channels 33.

FIGS. 12 through 14, 17 and 20 show corresponding refinements of the combined spray cone 12.

Figure 13:
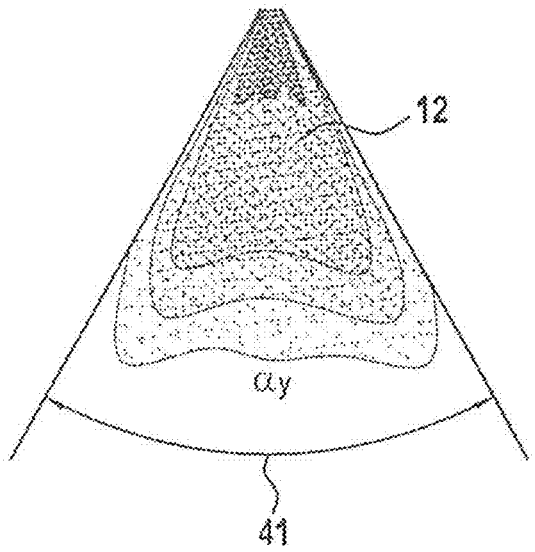
Figure 14:
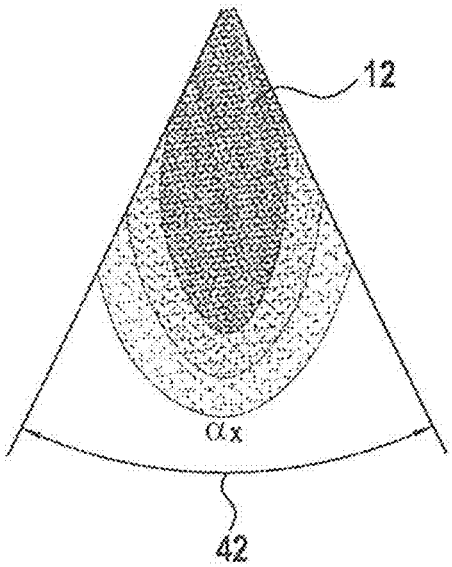
Figure 15:
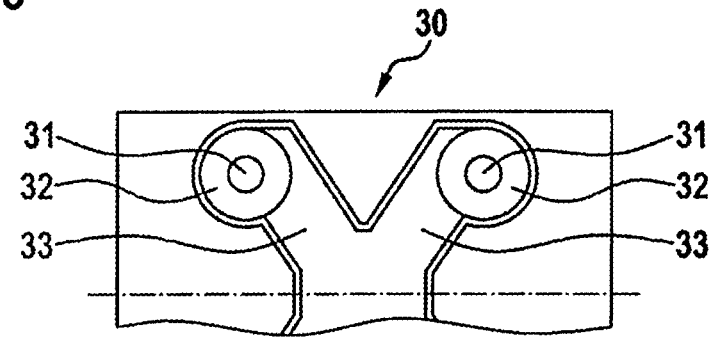

FIG. 13 shows an angle $\alpha_Y$ 41 of the spray cone 12, and FIG. 14 shows an angle $\alpha_X$ 42 of the spray cone 12.

Figure 18:
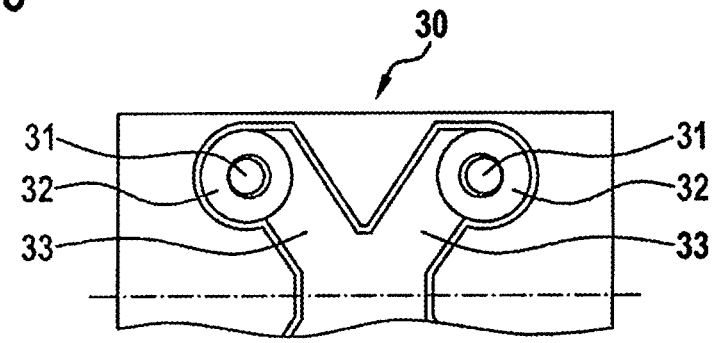
Figure 19:
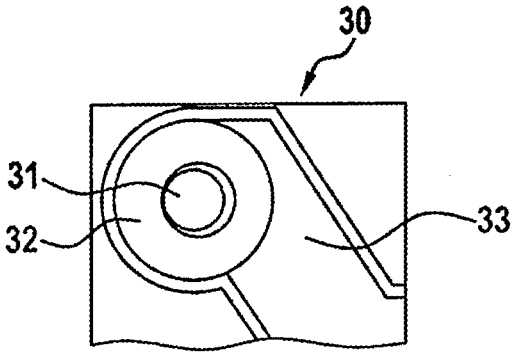
Figure 20:
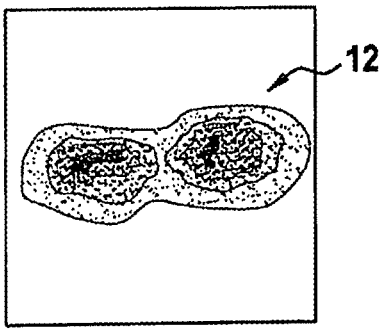

FIG. 18 shows the left or right part of FIG. 3-2 (the perspective is rotated by 90 degrees), and FIG. 19 shows a close up of one of the arms of FIG. 3-2.

These and further features and characteristics of the present invention are clarified further, in light of the following explanations:

An object of the present invention is to improve conventional atomization designs.

At low pressures of 3 bar to 10 bar, conventional treatment concepts, e.g., including turbulence atomization, produce non-uniform jet distributions and/or relatively large droplet sizes, e.g., having SMD values of ca. 80 μm to 150 μm.

The concept of the present invention is intended to produce a more uniform distribution inside of spray cone 12 and a marked reduction in the droplet size in the spray.

The approach of the present invention is based on attaining uniform spray distributions with the smallest drop sizes. In this context, a basic idea is to design and adapt the swirl geometry in spray orifice disk 10 in such a manner, that through the interaction of the jets after emergence from spray orifice 31, the spray pattern is oval-shaped, in particular, in cross section.

AdBlue metering (DNOX), water injection and fuel injection, in which oval sprays 12 prevent wall wetting, are suited as fields of application. In this manner, e.g., increased conversion rates in DNOX systems in the case of attachment near the engine, or improved dynamics in water and fuel injection, are possible.

Using a different layout of the channel geometry, e.g., a variation including a variation of the angle 36 subtended by channels 33, one starting point consists in forming jet pairs, which produce an oval cross-sectional shape in the entire spray 12, in particular, by combining individual jets. In combination with different orifice angles of inclination, the momentum of the flow of fluid 11 may be used to direct the jet of spray 12 into the appropriate position.

In order to obtain a desired spray shape, the swirl intensity and the orifice angle of inclination may be varied.

The number of orifices and the channel layout may be varied to obtain a flat spray.

The following advantages of the present invention become apparent:

(i) uniform and finely atomized spray,
(ii) effective atomization, even at low pressures, e.g., in comparison with turbulence atomization,
(iii) use of spray 12 for exhaust pipes having an oval shape,
(iv) reduction of wall wetting in the exhaust pipe or intake manifold,
(v) inexpensive design of spray orifice disk 10, which may be produced by stamping or laser drilling.

In certain examples of spray orifice disks of the present invention having a 4-hole geometry, every two channels 33 may be positioned parallelly to each other. In this context, the direction of rotation in swirl chambers 32 may be configured to be opposed for the two pairs. Due to that, the air of the atmosphere is drawn into the center of spray 12. An oval spray 12 is formed by combining individual jets. The direction of momentum may be determined by the layout of channels 33.

The shape of spray 12 may be influenced by changing the layout of the pairs of channels 33, by changing the swirl intensity and/or the orifice angle of inclination.

Figure 16:
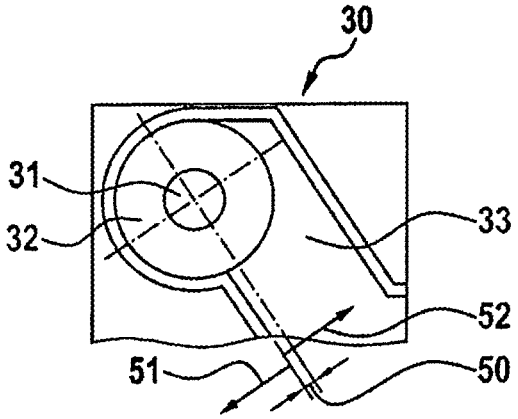
Figure 17:
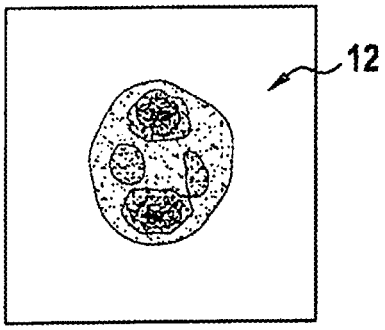

The following geometric and structural aspects of the present invention may be used individually or in arbitrary combination to obtain a flat shape of the atomization cone, in the sense of a flat spray having a uniform spray distribution:

(I) If (a) with regard to spray orifices 31, one labels spray orifice diameter d0 and spray orifice area A0, (b) with regard to swirl chamber 32, one labels swirl chamber diameter Ds, and (c) with regard to a channel 33, one labels channel width kn, channel depth kt, channel area Ap, and channel eccentricity kd, as shown in FIG. 16 by reference numeral 50, then the following relations and sizings are applicable to the present invention individually or in arbitrary combination:

$$1.2 \le \frac{Ds}{d0} \le 5.0 \quad 0.5 \le \frac{Ap}{A0} \le 10.0$$

$$0.1 \le \frac{Ap}{d0 \cdot Ds} \le 30 \quad 0.1 \le \frac{kt}{kb} \le 1.3$$

$$0 \le kd \le 0.8 \cdot d0$$

Channel eccentricity kd, which is denoted by reference numeral 50 in FIG. 16, may assume positive values in the direction of arrow 51 and negative values in the direction of arrow 52. Positive values provide an intensification of the swirl, negative values provide a reduction in the swirl of the jet emerging from a spray orifice 31.

(II) In the configurations according to FIGS. 3-2 and 5, angle 36 may be in the range of approximately 70° to approximately 120°, in order to form a swirl geometry where orifice pairs are formed, in which the swirl direction or rotational direction is opposed.

(III) In connection with the specific embodiments of FIGS. 7 and 8, the following must be considered:

The specific position of a spray orifice 31 may be on graduated circle diameters of different magnitudes. In this manner, in combination with the inclination of spray orifice 31, the shape of atomization or spray cone 12 may be adjusted.

In order to improve the uniformity, one may work with collision of jets in combination with swirl treatment. In this context, the spray orifices 31 used lie opposite to each other on a graduated circle diameter. The shape of a spray orifice 31 may be both cylindrical and conical, that is, narrowing in the direction of flow. The spray orifices may be inclined inwards. After the collision of the primary jets, atomization or spray cone 12 breaks up orthogonally to the plane of the jets. The shape of atomization or spray cone 12 may be adjusted, using the inclination of the spray orifice.

(IV) In the configurations of the present invention shown in FIGS. 12 through 14, 17 and 20, the spray orifices 31 forming the basis of atomization or spray cones 12 and the geometry of spray orifice disk 10 and of spray orifice set-up 30 may be configured in such a manner, that atomization or spray cones 12 have a uniform mass distribution; the shape of the atomization or spray cone being able to be distinctively flat to oval.

What is claimed is:

1. A spray orifice disk for a valve for a metering valve or an injection valve, for at least one of an internal combustion engine and an exhaust gas aftertreatment, comprising:

a disk body;

a spray orifice set-up which is formed in the disk body, the spray orifice set-up being configured with a plurality of spray orifices for dispensing supplied fluid as a spray, and respective channels for supplying the fluid to a respective ones of the spray orifices; and a swirl chamber formed at a transition between each specific ones of the channels and the respective one of the spray orifices;

wherein a center of the swirl chamber is arranged with an offset from a longitudinal axis of the channel, wherein the plurality of the spray orifices are arranged respectively on a first circle, and a second circle whose diameter is smaller than the first circle, whose center is a lateral center of the spray orifice disk, and adjacent holes of the spray orifices are arranged on different respective ones of the first and second circles, wherein a direction of the offset of the swirl chambers are inside of an acute angle formed by the channel connected to the spray orifice arranged on the first circle and the channel connected to the spray orifice arranged on the second circle.

2. The spray orifice disk as recited in claim 1, wherein an oval cross-sectional pattern of the spray is produced:

(i) at low pressures in the range of approximately 3·105 Pa (3 bar) to approximately 10·105 Pa (10 bar), (ii) to have a uniform distribution of the fluid in the spray, and/or (iii) to have a reduced droplet size of the spray, having an SMD value of less than 80 μm.

3. The spray orifice disk as recited in claim 1, wherein each of the channels connected to each of the plurality of spray orifices respectively extends from each said swirl chamber to a valve opening.

4. The spray orifice disk as recited in claim 1, wherein two of the spray orifices are formed on the first circle and the second circle respectively.

5. The spray orifice disk as recited in claim 1, wherein the fluid injected from the spray orifices connected to the channels which forms the acute angle have swirl directions opposite to each other.

6. A metering or injection valve for at least one of an internal combustion engine and an exhaust gas aftertreatment, comprising:

a valve seat body, which terminates a valve chamber and has a valve opening; and a spray orifice disk situated downstream from the valve seat body, wherein the spray orifice disk includes:

a disk body;

a spray orifice set-up which is formed in the disk body, the spray orifice set-up being configured with a plurality of spray orifices for dispensing supplied fluid as a spray, and respective channels for supplying the fluid to a respective ones of the spray orifices; and a swirl chamber formed at a transition between each specific ones of the channels and the respective one of the spray orifices;

wherein a center of the swirl chamber is arranged with an offset from a longitudinal axis of the channel, wherein the plurality of the spray orifices are arranged respectively on a first circle, and a second circle whose diameter is smaller than the first circle, whose center is a lateral center of the spray orifice disk, and adjacent holes of the spray orifices are arranged on different respective ones of the first and second circles, wherein a direction of the offset of the swirl chambers are inside of the acute angle formed by the channel connected to the spray orifice arranged on the first circle and the channel connected to the spray orifice arranged on the second circle.

* * * * *